United States Patent [19]

Kruyer

[11] 4,405,446

[45] Sep. 20, 1983

[54] PREPARATION OF BITUMEN FROTHS AND EMULSIONS FOR SEPARATION

[76] Inventor: Jan Kruyer, 9707-67A, Edmonton, Alberta, Canada, T6B 1S3

[21] Appl. No.: 338,600

[22] Filed: Mar. 15, 1982

[51] Int. Cl.[3] ..... C10G 33/06

[52] U.S. Cl. ..... 208/188; 208/11 LE; 252/361; 210/693; 210/DIG. 5; 422/224; 196/46

[58] Field of Search ..... 208/187, 188, 11 LE; 252/360, 362, 361; 196/46, 46.1; 422/224; 210/DIG. 5, 643, 690, 800

[56] References Cited

U.S. PATENT DOCUMENTS

| | | | |
|---|---|---|---|
| 3,399,765 | 9/1968 | Puddington et al. . | |
| 3,891,550 | 6/1975 | Gray et al. | 208/11 R X |
| 4,033,729 | 7/1977 | Capes et al. | 44/1 A |
| 4,272,360 | 6/1981 | Bialek | 208/188 |
| 4,321,147 | 3/1982 | McCoy et al. | 208/188 |
| 4,321,148 | 3/1982 | McCoy et al. | 208/188 |

FOREIGN PATENT DOCUMENTS

| | | | |
|---|---|---|---|
| 657876 | 2/1963 | Canada | 208/11 LE |

*Primary Examiner*—Delbert E. Gantz
*Assistant Examiner*—A. Pal
*Attorney, Agent, or Firm*—Thorpe, North & Western

[57] ABSTRACT

An oil and water mixture containing a dispersed phase and a continuous phase is passed for treatment through a rotating horizontal tumbler containing free bodies and a hydrocarbon diluent for the purpose of facilitating subsequent separation of the phases of the mixture. The free bodies tumbling with the mixture in the drum have affinity for the dispersed phase particles, and the hydrocarbon diluent reduces the viscosity of the oil phase thereby causing an increase in the particle size of the dispersed phase of the mixture. Some mixtures that may be treated include effluent streams from a hot-water oil sands extraction plant, oil-in-water emulsions from processes that use enhanced oil well recovery and bitumen froth.

11 Claims, 2 Drawing Figures

PREPARATION OF BITUMEN FROTHS AND EMULSIONS FOR SEPARATION

BACKGROUND OF THE INVENTION

The present invention relates to a method for treating an oil and water mixture of continuous phase and dispersed phase so as to facilitate subsequent separation of the phases. The intent of the present invention is to increase the average size of dispersed phase particles in the mixture under treatment.

This invention is primarily concerned with recovering bitumen or oil phase from oil and water mixtures produced from oil wells and oil or tar sands. Extensive deposits of oil sands, which are also known as tar sands and bituminous sands, are found in Northern Alberta, Canada. The sands are composed of siliceous material with grains generally having a size greater than that passing a 325 mesh screen (44 microns) and a relatively heavy, viscous petroleum called bitumen which fills the voids between the grains in quantities of from 5 to 21 percent of total composition. (All percentages referred to herein are in weight percent unless noted otherwise). Generally the bitumen content of the sand is between 5 and 15 percent. This bitumen contains typically 4.5 percent sulfer and 38 percent aromatics. Its specific gravity at 60° F. ranges generally from about 1.00 to about 1.06. The oil sands also contain clay and silt. Silt is defined as siliceous material which will pass a 325 mesh screen, but which is larger than 2 microns. Clay is material smaller than 2 microns including some siliceous material of that size. Extensive oil sand deposits are also found elsewhere in the world such as in the Orinoco heavy oil belt of Venezuela and in the area near Vernal, Utah. The mineral and bitumen of these deposits differ somewhat from those of the Alberta deposits. Compared with the Alberta oil sands, the Utah deposit contains a coarser sand, less clay and an even more viscous bitumen.

Much of the world resource of bitumen and heavy oil is deeply buried by overburden. For example, it has been estimated that only about 10 percent of the Alberta oil sand deposit is close enough to the earth's surface to be conveniently recovered by mining. The remainder is buried too deeply to be economically surface mined. Hydraulic mining or tunnel mining has been proposed for these deeper deposits. Generally, however, it is considered that enhanced recovery by steam injection, by injection of aqueous solutions, and/or by in situ combustion may possibly be more effective for obtaining bitumen or heavy oil from deeply buried formations. Such enhanced recovery methods use one or more oil wells that penetrate the formation and stimulate or recover the resource. Recovery of bitumen from a well by steam stimulation is described in Canadian Pat. No. 822,985 granted on Sept. 16, 1969 to Fred D. Muggee. Depending upon the procedure employed, enhanced recovery methods either produce mixtures of oil, water and water-in-oil emulsions or produce oil-in-water emulsions.

There are several well-known procedures for separating bitumen from mined oil sands. In a hot water method such as disclosed in Canadian Pat. No. 841,581 issued May 12, 1979 to Paul H. Floyd, et. al., the bituminous sands are jetted with steam and mulled with a minor amount of hot water and sodium hydroxide in a conditioning drum to produce a pulp which passes from the conditioning drum through a screen which removes debris, rocks and oversize lumps to a sump where it is diluted with additional water. It is hereafter carried into a separation cell.

In the separation cell, sand settles to the bottom as tailings which are discarded. Bitumen rises to the top of the cell in the form of a bituminous froth which is called the primary froth product. An aqueous middlings layer containing some mineral and bitumen is formed between these layers. A scavenging step is normally conducted on this middlings layer in a separate flotation zone. In this scavenging step, the middlings are aerated so as to produce a scavenger tailings product, which is discarded, and a scavenger froth product. The scavenger forth product is thereafter treated to remove some of its high water and mineral matter content and is thereafter combined with the primary froth product for further treatment. This combined froth product typically contains about 52 percent bitumen, 6 percent minerals, 41 percent water, all by weight, and may contain from 20 to 70 volume percent air. It resembles a liquid foam that is difficult to pump and, for that reason, is usually treated with steam to improve its flow characteristics.

The high water and mineral contents of the combined froth product normally are reduced by diluting it with a hydrocarbon diluent such as naphtha. It is then centrifuged to produce a tailings product and a final bitumen product that typically contains essentially no water and about 1.3 percent solids and that is suitable for coking, hydrovisbreaking and other refining techniques for producing a synthetic crude oil. The tailings products, containing some naphtha, are discarded.

There are basically four effluent streams from the Hot Water Process. Each carries with it some of the bitumen of the feed thereby reducing the efficiency of the process. These include the oversize material, the sand from the separation cells, the silt and clay from the scavenger cells and the tailings from the centrifuges. Up to 10 percent of the bitumen in the original feed and up to 2½ percent of the naphtha stream may be lost in this manner. Much of this bitumen effluent finds its way into large retention ponds that are typical of the Hot Water Process. The bottom of one such retention pond may contain up to 50 percent dispersed mineral matter substantially of clay and silt as well as 5 percent bitumen. As disclosed in Canadian Pat. No. 975,697 issued on Oct. 7, 1975 to Davitt H. James this part of the pond contents, referred to as sludge, is a potential source of bitumen.

The Hot Water Process described in the preceding paragraphs separates bitumen from a prepared oil sand slurry. Various methods for preparing oil sand slurries are taught in the prior art, as for example disclosed in Canadian Pat. No. 918,588 issued on Jan. 9, 1973 to Marshall R. Smith, et. al., and in U.S. Pat. No. 3,968,572 issued on July 13, 1976 to Frederick C. Stuchberry. These apparatus as disclosed were especially designed to form a slurry that is hot, that contains finely dispersed air bubbles and wherein the bitumen is in the form of small flecks. Such a slurry is amenable to subsequent separation in a hot water bath after dilution wherein bitumen forms into a froth that rises to the top of the bath and is skimmed therefrom. Alkaline reagents such as sodium hydroxide are normally added in this process to give to the slurry those properties that provide for efficient flotation of the bitumen in said water bath. However, in the presence of sodium hydroxide, fine clay particles in the effluent streams from this process do not settle readily. For this reason inordinately large settling ponds are required to contain the effluents from commercial hot water oil sands extraction plants.

The present invention applies to a method of treating various streams from oil sand operations having a dispersed oil or aqueous phase to cause combination of dispersed particles, which combination improves the recovery of the oil phase by the use of apertured oleophilic endless conveyor belts to achieve oil phase-aqueous phase separations. These processes are superior to the Hot Water Process because separations are conducted at lower process temperatures and with lower water requirements. For comparable oil sand feedstocks, the bitumen produced by combination of dispersed phase particles followed by oil phase-aqueous phase separation with an apertured oleophilic belt as typically disclosed is of higher quality than the froth produced by a Hot Water Process.

The apertured oleophilic conveyor belt, that may be used to separate emulsions, slurries, or mixtures of oil phase and aqueous phase, typically consists of a mesh belt that is woven from fibre, string or wire of high tensile strength and fatigue resistance, that is oleophilic by nature or that will bond strongly with a belt coating that is oleophilic. This belt typically is supported by two conveyor end rolls that provide tension and form to the belt. Separation is achieved by passing a slurry, emulsion or mixture of oil phase and water phase, with or without particulate solids, through the belt one or more times. Water phase and particulate solids in the water phase pass through the belt apertures and are discarded while oil phase attaches itself to the belt because of its attraction for the oleophilic belt surfaces. The oil phase subsequently is recovered from said belt as a product. Typical processes are disclosed in U.S. Pat. No. 4,224,138 and U.S. Pat. No. 4,236,995 and copending U.S. patent application, Ser. No. 178,000.

BRIEF DESCRIPTION OF THE INVENTION

In accordance with the broadest concepts of the present invention, a water and oil mixture of continuous phase and dispersed phase in the presence of a hydrocarbon diluent is tumbled with free bodies in a horizontal rotating drum to deaerate the mixture and reduce the viscosity of the oil phase thereby promoting migration of particulate matter to the aqueous phase and also promoting the combining of dispersed phase volume to prepare a mixture suitable for separation by an oleophilic apertured endless conveyor belt or other means.

The free bodies of the present invention are spheres, or more complex bodies, with surfaces that have affinity for dispersed phase particles. When tumbled in a drum together with a froth or emulsion in the presence of a hydrocarbon diluent these free bodies cause particle size growth of the dispersed phase in this drum and promote phase separation. The use of free bodies for separation of oil and water phase without the use of hydrocarbon diluent is the subject of copending U.S. patent application, Ser. No. 178,000.

In one embodiment of the present invention, a continuous feed of bitumen froth, or a water-in-oil emulsion with added hydrocarbon diluent is tumbled in a drum with free bodies (at least a portion of which have hydrophilic surfaces) to produce a continuous bitumen or oil phase product with reduced air content and/or wherein the dispersed aqueous phase particles have grown in size.

In a second embodiment, a continuous feed of oil-in-water emulsion, obtained from enhanced oil well or bitumen recovery, is tumbled in a drum with hydrocarbon diluent, other reagents and oleophilic free bodies to produce a product of oil phase droplets and streamers in a continuous water phase.

Following is a partial list of feedstocks which may be treated according to the present invention:

1. A bituminous froth such as from the primary froth product or from the scavenger froth product of a hot water oil sand extraction plant in a combination of both froth products.
2. The middlings drag stream of a hot water oil sands extraction plant containing dispersed bitumen particles.
3. One or more of the effluent streams of a hot water oil sands extraction plant containing dispersed bitumen particles.
4. An effluent stream of a hot water oil sands extraction plant containing dispersed bitumen with naphtha particles.
5. Oil-in-water and/or water-in-oil emulsions, such as may have been obtained by enhanced oil recovery methods, tar sand operations, oil shale operations and the like.
6. A water-in-oil emulsion containing dispersed water-wet mineral particles.
7. A combination of two or more of the above sources in one operation.

It is, therefore, an object of the present invention to provide a process for the breaking of emulsions and reduction of air in froths in the processing aqueous bitumen mixtures which result in increased particle sizes of the dispersed phase enabling more efficient oil phase-aqueous phase separations.

It is also an object of the present invention to provide a process which will reduce the viscosity of oil phase thereby promoting aqueous phase combination and the transfer of particulate matter to the aqueous phase.

It is also an object of the present invention to provide a process which may lower the temperature at which water phase-oil phase separation may take place effectively under conditions of enhanced interfacial tension between the phases.

DRAWINGS

DETAILED DESCRIPTION OF THE INVENTION

Figure 1:
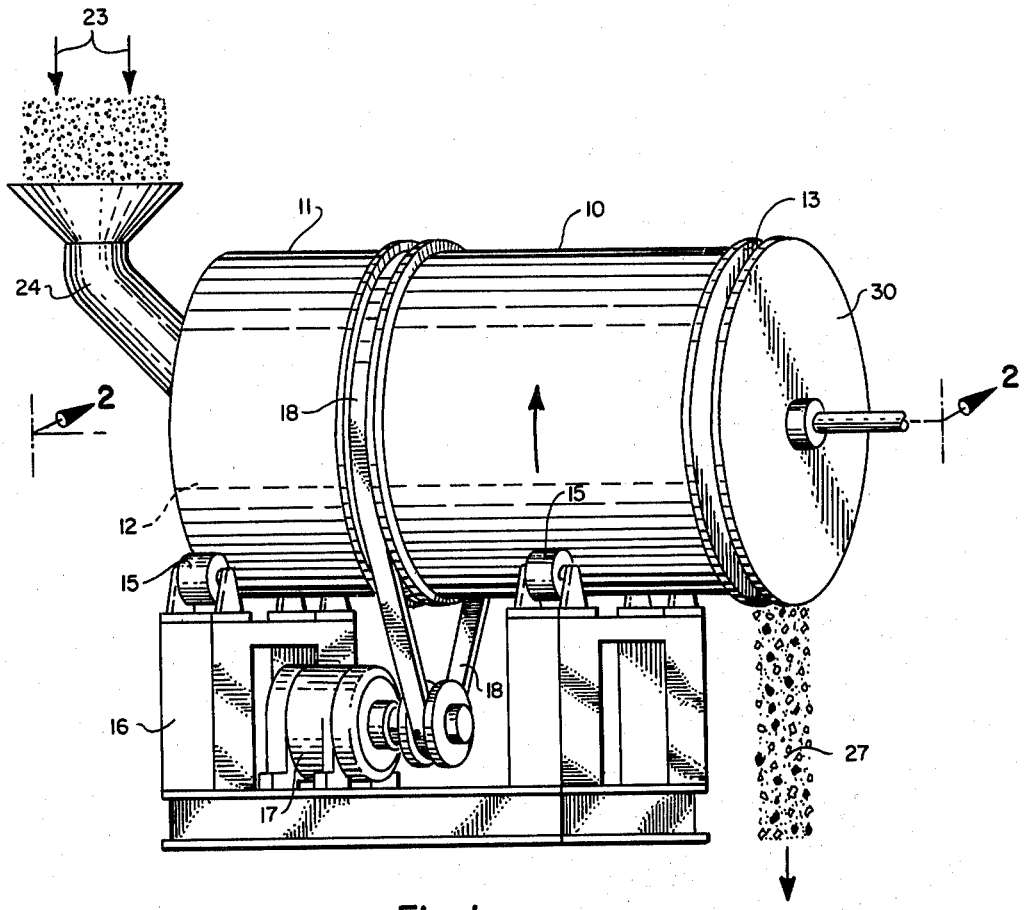
FIG. 1 is a perspective view showing the horizontal drum used in the present invention to tumble an oil phase-water phase feed with free bodies and hydrocarbon diluent for the purpose of increasing the size of dispersed phase particles.

As used in the present invention "water-in-oil emulsion", "oil phase" and "bitumen" all refer to fossil-based oils that may contain water droplets and particulate solids. "Bitumen froth" refers to bitumen that contains aqueous phase and solids, and significant quantities of entrained gas. "Oil-in-water emulsion" refers to a stable mixture of small oil phase droplets dispersed in a continuous aqueous phase and may contain up to about 5 percent particulate solids. "Slurry" refers to a mixture containing continuous water phase, dispersed oil phase and more than 5 percent particulate solids. "Aqueous phase" refers to any type of water phase, which is continuous or dispersed and may contain particulate solids, oil particles and/or chemicals. "Dispersed phase" refers to that phase in the mixture, emulsion or slurry that is not continuous.

It is to be understood that the present invention is to prepare mixtures of heavy or light oil and water which may or may not contain particulate solids for separation. For example, Canadian Pat. No. 726,683 issued on Jan. 25, 1966 to Albert F. Lenhart discloses that oils derived from solid carbonaceous materials, such as from oil shales, coals, and the like, usually are recovered in the form of oil-water emulsions when in-situ combustion is practiced to convert these solid carbonaceous materials to oils. That same patent also discloses that in the recovery of conventional crude oil from wells, oil-water emulsions are produced as well on many occasions. A paper by L. S. Johnson, et. al. of the U.S. Department of Energy presented at the 13th Intersociety Energy Conversion Engineering Conference in San Diego, Calif. on Aug. 20–25, 1978 discloses that oil-water emulsions containing particulate solids usually are produced when oil is recovered by in-situ combustion of tar sands.

In some cases, it has been found to be desirable to add a hydrocarbon diluent to certain mixtures of oil phase and aqueous phase prior to or during treatment in a rotating drum in the presence of free bodies. The addition of hydrocarbon diluent to the mixture reduces the viscosity and density of the oil phase of said mixture. The addition of a hydrocarbon diluent also permits treatment of such a mixture at a lower temperature. It is known by those familiar in the art that, in the range from room temperature to the temperature of boiling water, the interfacial tension between bitumen and water decreases with an increase in temperature. Adding a hydrocarbon diluent to said mixture may permit treatment of said mixture at a lower temperature and under conditions of higher interfacial tension, providing for more effective separation or for more effective particle size growth of the dispersed phase of the mixture.

For mixtures consisting of an oil in water emulsion, the hydrocarbon diluent by itself is not used to collect the dispersed phase of the mixture. Rather, said diluent is used to assist the free bodies to increase the particle size of the dispersed oil phase in said mixture into oil droplets or oil bodies to permit more effective subsequent separation.

For mixtures consisting of a water in oil emulsion, the hydrocarbon diluent serves to reduce the viscosity and density of the continuous oil phase of the mixture and thereby may permit the free bodies to achieve a more effective separation of the dispersed water wet solids and water particles out of the oil phase into larger drops or bodies of aqueous phase. Separation of the oil phase and aqueous phase products that leave the drum of the present invention may be done subsequently by means of an oleophilic sieve, by means of an apertured oleophilic conveyor belt, by means of settling with the use of the force of gravity or with the use of centrifugal force such as with centrifuges or hydrocyclones. Additions of hydrocarbon diluent to the drum of the present invention may reduce the viscosity of the oil phase of the mixture under treatment in the drum and may also reduce the density of said oil phase and thus may provide for effective settling and separation of the aqueous phase from the oil phase after removal from said drum.

On occasion, when an oil in water emulsion is in the process of being broken, a double emulsion may form in the drum of the present invention. This double emulsion consists of small aqueous phase particles trapped in larger oil phase particles that are dispersed in the continuous aqueous phase contained in said drum. Addition of hydrocarbon diluent to said drum will, in many cases, reduce the formation of such double emulsions and will provide for more effective separation of water phase from oil phase.

The amount of diluent added to the mixture of the drum may preferably range from one part diluent and one hundred parts oil in the mixture to ten parts diluent and one part oil in the mixture. When a diluent is used, the preferred range of viscosity of the resulting oil phase of the mixture agitating in the drum is within the range of 0.01 to 500 poises.

When the mixture to be treated by the drum and the free bodies of the present invention consists of a bitumen froth, such as may be produced for example by the Hot Water Extraction Process from mined oil sand in the form of a primary froth product or a scavenger froth product, the diluent added to the mixture as described above will also aid in the collapse of air bubbles in said mixture.

The present invention takes advantage of these discoveries to prepare mixtures of dispersed phase and continuous phase for separation by an apertured oleophilic belt or other appropriate means.

Figure 2:
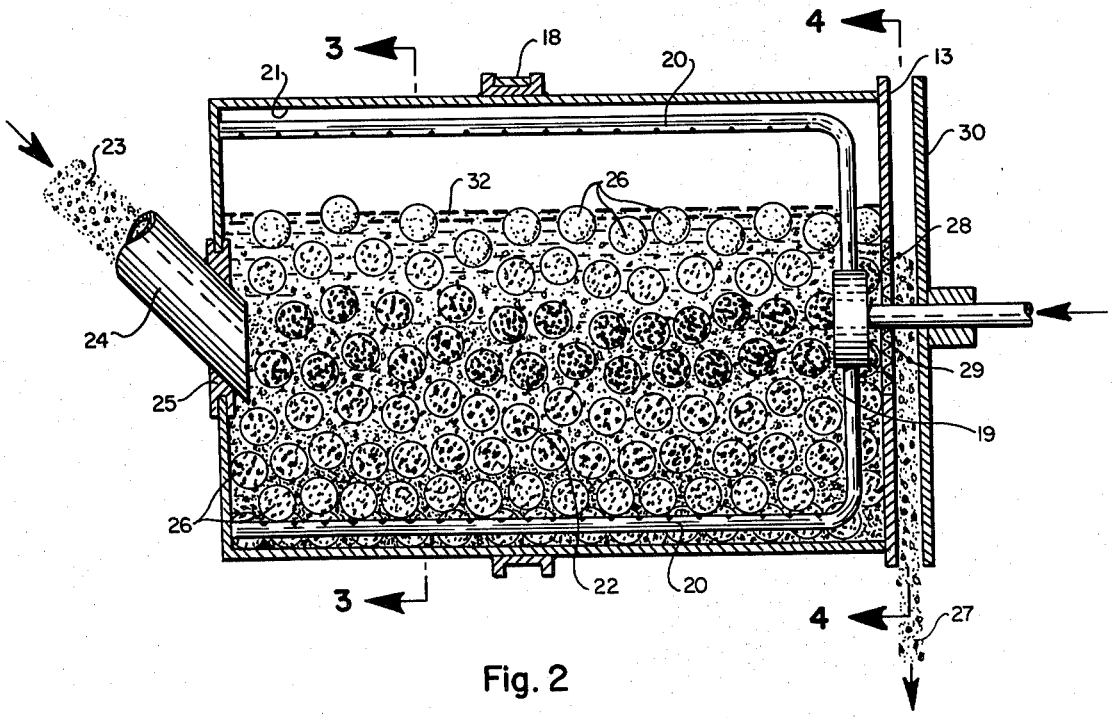
FIG. 2 is a cross sectional view of the drum of FIG. 1 taken along the lines 2—2 of FIG. 1 showing the contents of the drum and product flow through the drum.

FIGS. 1 and 2 illustrate an apparatus for treating, with free bodies and added hydrocarbon diluent, a continuous feed mixture of oil phase and aqueous phase to remove entrapped air and to enlarge the particle size of dispersed particles enabling better subsequent separation of the two phases.

The drum 10 of FIG. 1 is a horizontal, rotating cylinder having rear 12 and front 13 ends, each partially closed by a washer. The cylindrical side wall 11 is provided with internal protrusions or ribs 14 that encourage mixing of the drum contents by the rotating drum. The drum is supported on rollers 15 connected to a frame 16 and contains a drive motor 17 and drive means 18. Hydrocarbon diluent and steam, if desired, may be introduced into the interior of the drum 10, illustrated in FIG. 2 through a rotatable distributor valve 19, which feeds to a series of perforated pipes 20. These pipes 20 extend longitudinally along the interior cylindrical surface 21 of the drum 10 in spaced relationship about its circumference. The valve 19 feeds the hydrocarbon diluent to the pipes 20 continuously or as necessary. The mixture to be treated 23 is fed into the rear end 12 of the drum by way of a pipe 24. A seal 25 prevents drum contents 22 from spilling out of the rear 12 of the drum. Alternately, the mixture may be fed to the drum 10 through a flexible rotating hose that is attached to the central part of the drum rear 12. The drum contains free bodies 26 that tumble through the drum contents 22. Product 27 leaves the drum 10 through an opening 28 that is covered with an apertured wall 29 such as a mesh screen, or a perforated plate to permit passage of prepared product but which prevents passage of free bodies 26 from the drum 10.

If desired, the hydrocarbon diluent may be added to the mixture feed before it enters the drum or may be added to the drum by other means.

The drum 10 may be rotated by the motor 17 and associated drive 18 at any rate of rotation that is most effective for the mixture 23 to be treated from very slow up to but not exceeding two times the critical rate. The critical rate of rotation is reached when at the inside drum surface 21 the centrifugal force exceeds the force of gravity. Critical rotation is defined in revolutions per minute as:

$$\text{Critical rotation rate} = \sqrt{\frac{2936}{r}}$$

where r is the drum inner radius in feet. Above this critical rate, some drum content commences to attach itself to the drum wall and does not readily mix with the remainder of the drum contents. At rotation rates between one and two times the critical rate, progressively more of the drum content attaches itself to the drum wall and does not take part in the tumbling process operating in the drum 10. Rotating the drum 10 at more than twice the critical rate is not the intent of the present invention. The desired rate of drum 10 rotation varies with each type of feed 23 being treated and is influenced among others by the viscosity of the mixture 22, the density difference between the mixture 22 and the free bodies 26, the solids content of the mixture 22 and the level of the drum contents 22.

For many of the mixtures 22 treated the drum 10 will be maintained more than half full, level 32, and for some mixtures 22 the drum 10 may be kept substantially filled, level 33, as long as the viscosity of the feed mixture 22, the solids concentration and the density difference between the components of the mixture 22 and the free bodies 26 permit for a continuous thorough mixing of the drum contents with said free bodies 26.

The oil and water mixtures to which this invention is directed are preferably those having a bitumen content of 20% by weight or above. The solids content should not exceed 70% by weight and preferably will be 50% or lower with the remainder of the mixture being aqueous phase. It is believed that the hydrocarbon diluent serves at least three basic functions. One function is to reduce the viscosity of the oil phase so that entrapped solids will be more easily transferred to the aqueous phase. Secondly, in high viscosity bitumens, the diluent enhances the ability of oleophilic free bodies to coalesce, agglormerate or otherwise increase the size of the bitumen particles which would normally be too viscous to temporarily adhere to the free bodies in order to grow in size. Thirdly, the diluent reduces the viscosity of the bitumen or oil phase to a viscosity that would, without the diluent, be attainable only at higher temperatures. The lessening of viscosity at lower temperatures takes advantage of the higher interfacial tension between bitumen and water at such lower temperature in promoting phase separation.

The hydrocarbon diluent that is used may be any hydrocarbon which is miscible with the oil phase of the mixture but not with the aqueous phase. Especially preferred is that fraction obtained from the refining of crude petroleum referred to as naphtha.

Without in any way attempting to limit the scope of this invention, the following theory is offered as to how particle size growth is accomplished. It is believed that the oil phase particle size growth that takes place when a mixture of continuous aqueous phase and dispersed oil phase is tumbled in a drum containing a hydrocarbon diluent in the presence of oleophilic free body surfaces may be explained as a mechanism of oil film building and shedding. In this mechanism, dispersed oil phase particles of the mixture in the drum are reduced in viscosity and come in contact with an oleophilic surface, adhere thereto, unite on that surface with other oil phase particles and form into a coat that continues to grow in thickness until the forces of self adhesion in the oil phase coat cannot resist the forces of erosion on the coat surface caused by the movement of mixture past this coat. At that instant the coat begins to shed oil phase particles which, for the conditions of the present invention on the average, are larger than the oil phase particles originally present in the mixture fed to the drum. The force of erosion varies with location in the drum contents; and since the free bodies in the drum are mixing and moving in the drum, therefore the force of erosion on the oleophilic surface of a free body varies with item thus permitting a cyclic accumulation of oil phase on free bodies and a cyclic shedding of accumulated oil phase therefrom. The shed oil phase particles appear to have an optimum size with a particular oil phase viscosity. Lowering the viscosity beyond this point tends to lessen particle size from the optimum. However, such particles may still be larger than they were to begin with.

Similarly, free bodies with hydrophilic surfaces may be used to collect water phase on their surfaces and to provide for an increase of particle size of aqueous phase in a mixture with continuous oil phase. A combination of oleophilic and hydrophilic free bodies may be used to advantage in cases where it is desirable to remove particles of continuous phase out of dispersed phase particles that are being increased in size. Thus free bodies with hydrophilic surfaces may be added to the free bodies with oleophilic surfaces in the drum to treat a mixture containing continuous aqueous phase. Conversely, free bodies with oleophilic surfaces may be added to the free bodies with hydrophilic surfaces in the drum to treat a mixture containing continuous oil phase.

Free bodies may be in the form of spheres, spheroids, pebbles, teardrops, rods, discs, saddles, snowflakes or of any other shape, simple or complex, which is effective in searching out dispersed phase particles in the mixture. The free bodies may be solid, hollow, or apertured. They may also be smooth but are preferably of a rough or of a porous surface. The size of the free bodies used in said drum depends to a large degree upon the consistency of the mixture in the drum that is to be treated. The mean dimension of these free bodies preferably is within the range 0.1 to 10.0 inches and most preferably within the range 0.5 to 2.0 inches. However free bodies larger than 10 inches and smaller than 0.1 inch can be used without departing from the scope of the present invention.

The free bodies may also be configured to contain both oleophilic and hydrophilic surfaces. Examples of such bodies are disclosed in U.S. copending application, Ser. No. 178,000.

The desired density of the free bodies varies with the shape and size of the bodies used, the viscosity of the oil phase, the amount of hydrocarbon diluent, the solids content of the mixture and the level of the contents maintained in the drum. It is preferably within the range 60 to 600 pounds per cubic foot and most preferably within the range 100 to 300 pounds per cubic foot.

Free bodies may be cast, molded, formed or fabricated in other ways. Oleophilic free bodies may be made with oleophilic materials or they may be made from other materials and then covered with a coating of a strongly oleophilic material that is abrasion resistant, resistant to oil phase of the mixture under treatment and that may be made to adhere strongly to the body. Suitable oleophilic materials that may be used in the fabrication of oleophilic free bodies are neoprene, urethane, cadmium, plastics and artificial rubbers. Hydrophilic free bodies may be made using ceramics, glass, carbides or other strongly hydrophilic materials. Pebbles or flint may be used as well.

The desired viscosity of the phases of the mixture depends upon which is the continuous phase. When oil is the continuous phase of the mixture, sufficient hydrocarbon diluent is added to maintain viscosity of the oil phase such that the free bodies are permitted to freely travel through the mixture. Preferably the viscosity will be within the range 0.10 to 500 poises, with the most preferred range being 1.0 to 50 poises. When oil is the dispersed phase of the mixture, the preferred viscosity of the oil phase is such as to provide optimum "tackiness" to the oil phase particles and still allow removal of solids to the aqueous phase. Generally, "tackiness" refers to the ability of oil particles to adhere to themselves and to oleophilic surfaces as described above and will also be in the range of 0.10 to 500 poises.

While particle size enlargement may be achieved in small rotating horizontal drums, effectiveness of the present invention may be enhanced by the use of large diameter drums since these, for a given mixing action, may rotate at a slower rate. Such a slower rate of rotation in larger drum sizes may provide for longer accumulation and shedding cycles of dispersed phase on and from free body surfaces and in many cases provides for improved performance of the present invention. The preferred drum diameter is within the range 7 to 70 feet, and the preferred drum length is within the range 10 to 200 feet.

Reagents other than hydrocarbon diluents may be added to the mixture before it enters the drum or while it is in the drum for the purpose of aiding in the process of the present invention, for breaking emulsions, for increasing the affinity of the dispersed phase for the surfaces of the free bodies, for increasing the affinity of the surfaces of the free bodies, for the dispersed phase and/or for increasing the affinity of particulate solids in the mixture for one of the phases of the mixture. Addition of inorganic alkaline earth hydroxides or salts, such as for example calcium sulphate or calcium hydroxide is very effective for breaking tight oil sand oil-in-water emulsions and for rapid accumulation of bitumen coatings on the free bodies in the mixture. Non-ionic water soluble-polyethylene oxide polymers having a molecular weight in the range of 10,000 to 7,000,000 added to the mixture may serve to aid the alkaline earth chemicals in breaking tight oil-in-water emulsions. Suitable temperature for adding such polymers to the mixture is when the mixture is in the range of 120° to 210° F. Depending upon the desired temperature for uniting of dispersed oil phase particles, this polymer addition may be made to the drum contents or it may be made to the feed prior to entering the drum. In this latter case, the feed may be cooled prior to entering the drum for the purpose of operating both the chemical treatment step and the dispersed particle size growth step at differing optimum temperatures. U.S. Pat. No. 4,058,453 issued on Nov. 15, 1977 to Mahendra S. Patel, et. al., discloses the use of such a polymer mixture to break an oil-in-water emulsion. However, instead of using free bodies and a hydrocarbon diluent to enlarge the size of dispersed phase particles as disclosed in the present invention, Patel, et. al., disclose the need for a hydrocarbon solvent to collect the dispersed phase. This is to be distinguished from the present invention when the hydrocarbon is used to reduce viscosity and not as a collecting solvent.

Non-ionic surface active compounds, as for example a chemical demulsifier comprising polyethoxyalkene compound, sold under the trade name of NALCO D-1645 produced by the Nalco Chemical Company, may be added to the feed or to the drum for the purpose of breaking a water-in-oil emulsion and for making it easier for the free bodies to enlarge dispersed water phase particles.

Another demulsifier for adding to a water-in-oil emulsion in the present invention is sold under the trade name of BREAXIT 7941 and comprises a mixture of: (1) One part of the reaction product of diethyl ethanolamine with premixed propylene oxide and ethylene oxide; and (2) approximately three parts of a palmitic acid ester of the reaction product of an alkyl phenol formaldehyde resin with ethlene oxide. Other demulsifiers that may aid free bodies in increasing the mean water particle size of a water-in-oil emulsion in the present invention are polyoxypropylene glycols produced by the Wyandotte Chemical Company under the tradename "Pluronic".

An enhanced transfer of particulate solids to the water phase of the mixture tumbling with free bodies in the drum of the present invention may, in some mixtures, be effected by addition to these mixtures of hydrophilic surface active transfer agents, such as polyphosphates. Any water soluable salt of pyrophosphoric acid, $H_2P_2O_7$, such as for example tetrasodium pyrophosphate or sodium tripolyphosphate, are transfer agents and may be mixed with the feed or the drum contents in proportion of 0.01 percent to 1.0 percent to effect an improvement in the recovery of particulate solids in the water phase. Addition of sodium hydroxide with said polyphosphate reagent in about equal proportion may aid in effecting the improvement.

In instances where the oil phase of the mixture may contain heavy mineral, for example, bitumen may contain as high as 1 to 10 percent of heavy minerals as for example zircon, rutile, ilmenite, tourmaline, apatite, staurolite, garnet, etc. It may be desirable to employ chelating agents to make these particulate heavy minerals water wet and cause them to report to the water phase. Examples of suitable chelating agents are ethylenediamine tetraacetic acid, naturally occurring amino acids, sodium gluconate, gluconic acid, sodium oxalate and diethylene glycol. Chelating agents may be added to mixtures wherein oil is the continuous phase or they may be added to mixtures where water is the continuous phase. Generally they are the most effective when added to mixtures in which oil is the continuous phase.

The following example is illustrative of the present invention but is not to be considered a limitation thereof. For instance, the examples disclosed in copending application, Ser. No. 178,000 filed Aug. 14, 1980 could readily be modified by the addition of a hydrocarbon diluent.

EXAMPLE

A primary froth product from a hot water oil sands extraction plant containing 42 percent bitumen, 12 percent solids and 46 percent water is treated in a horizontal rotating drum as shown in FIG. 1. Lengthwise baffels on the interior cylindrical wall of the drum cause mixing of the drum contents and prevent the cylinder wall from sliding past the drum contents. The contents of the drum are maintained at a temperature of 100° F. The 6.0 feet diameter 6.0 feet long drum is filled to one-half full with 0.75 inch flint pebbles and 0.75 inch spheres molded from a mixture of litharge and neoprene to give spheres a density of 150 pounds per cubic foot. There are about an equal number of pebbles and spheres in the drum that rotates at 10 rpm. Six tons per hour of froth, containing 35 volume percent air are fed continuously to the drum that is kept filled. Six tons of hydrocarbon diluent naphtha is fed to the drum through the same feed pipe and mixes with the froth in the drum. Air bubbles of the froth feed collapse in the drum because of the tumbling and stirring action of the free bodies in conjunction with the dilution of the froth by naphtha. The produce that leaves the drum through the mesh covered exit consists of a stream of water and oil that readily separate into a top layer of oil phase and a bottom layer of aqueous phase when put into a vessel. The aqueous phase contains water wet solids and the oil phase contains less than 10 percent water and less than 5 percent solids.

Although the invention as has been described is deemed to be that which forms the preferred embodiments thereof, it is recognized that departures may be made therefrom and still be within the scope of the invention which is not to be limited to the details disclosed but is to be accorded the full scope of the claims so as to include any and all equivalent methods and apparatus. For example, the drum may be inclined instead of being perfectly horizontal without departing from the scope of the invention. Other similar modifications will also become apparent to those skilled in the art.

I claim:

1. A method for preparing a mixture of aqueous phase and oil phase for separation wherein one of said phases is dispersed and the other is continuous which comprises the steps of:

(a) introducing said mixture into a generally horizontal rotating drum containing a hydrocarbon diluent and free bodies that tumble in said drum, at least some of said free bodies having oleophilic surfaces that have affinity for the oil phase of said mixture, (b) agitating said mixture, diluent and free bodies in said rotating drum such that said free bodies continually mix with said mixture and diluent causing said diluent to unite with the oil phase of said mixture and causing the dispersed phase volumes of said mixture to unite on the surface of the free bodies to which they are attracted and grow into larger sized volumes which are ultimately sloughed off the free bodies to which they have been attracted, and (c) removing said diluted oil phase and said aqueous phase from said drum for subsequent separation into a separate oil phase product and a separate aqueous phase product.

2. A method as in claim 1 wherein the hydrocarbon diluent is naphtha.

3. A method as in claim 2 wherein said mixture and said diluent are continuously introduced into said drum and said diluted oil phase and said aqueous phase are continuously removed from said drum.

4. A method as in claim 3 wherein said mixture and said diluent are combined prior to being introduced into said drum.

5. A method as in claim 3 wherein said mixture contains particulate solids that are smaller in size than the average size of said free bodies.

6. A method as in claim 3 wherein other reagents are added to said drum in addition to said diluent.

7. A method as in claim 6 wherein said reagents are of the group consisting of demulsifiers, hydrophilic surface active agents, and/or chelating agents.

8. A method as in claim 2 wherein said mixture is a water in heavy oil or bitumen emulsion.

9. A method as in claim 8 wherein said emulsion is a bitumen froth produced by the Hot Water Extraction Process for separating mined oil sand.

10. A method as in claim 9 wherein said froth is deaerated during said agitation by the action of said free bodies as these continually mix with said froth in said rotating drum.

11. A method as in claim 2 wherein said mixture is in situ produced emulsion of water and heavy oil, bitumen, or oil from oil shale.

* * * * *